US005724817A

United States Patent [19]

Nishishita

[11] Patent Number: 5,724,817

[45] Date of Patent: Mar. 10, 1998

[54] LAMINATED HEAT EXCHANGER

[75] Inventor: Kunihiko Nishishita, Konan, Japan

[73] Assignee: Zexel Corporation, Tokyo, Japan

[21] Appl. No.: 526,237

[22] Filed: Sep. 11, 1995

[30] Foreign Application Priority Data

Sep. 9, 1994 [JP] Japan ..... 6-241984

[51] Int. Cl.[6] ..... F25B 41/04

[52] U.S. Cl. ..... 62/216; 62/299

[58] Field of Search ..... 62/216, 225, 299, 62/527, 528

[56] References Cited

U.S. PATENT DOCUMENTS 2,540,649 2/1951 Boylan ..... 62/299
3,858,406 1/1975 Izumi ..... 62/225
4,468,054 8/1984 Orth ..... 285/137 R
4,589,265 5/1986 Nozawa ..... 62/527
5,169,178 12/1992 Hunzinger ..... 285/26

*Primary Examiner*—William E. Tapolcai
*Attorney, Agent, or Firm*—Wenderoth, Lind & Ponack

[57] ABSTRACT

The object of the present invention is to provide a laminated heat exchanger having a block type expansion valve which is mounted without using O-rings or screws. In the laminated heat exchanger, the block main body, which is a component of the block type expansion valve, is brazed in a furnace to a pair of intake/outlet portions that lie parallel to each other on the laminated heat exchanger. The other components of the block type expansion valve are mounted after the brazing operation. This achieves an improvement in the secureness and seal between the block main body and the intake/outlet portions. With the above arrangement, it is possible to eliminate parts used for fixing and sealing the block type expansion valve and the intake/outlet portions.

5 Claims, 9 Drawing Sheets

LAMINATED HEAT EXCHANGER

BACKGROUND OF THE INVENTION

1. Field of the Invention

The present invention relates to a laminated heat exchanger used, for instance, in an air conditioning system for vehicles and, in particular, it relates to an improvement in the structure for connecting a block type expansion valve.

2. Description of the Related Art

Structures provided with a block type expansion valve in the vicinity of the intake/outlet portions of a laminated heat exchanger in the known art include the one shown in the first and second drawings of Japanese Unexamined Patent Publication No. 64-28762.

In this example, piping for coolant inflow and piping for coolant outflow for the laminated heat exchanger are provided running parallel to each other with a specific distance between them. At the free ends of the piping for coolant inflow and the piping for coolant outflow, a coupling member for connecting a block type expansion valve, is provided. In the coupling member, an inflow piping connecting through hole and an outflow piping connecting through hole are provided, for inserting the piping for coolant inflow and the piping for coolant outflow respectively. Holes, into which the free end of the piping for coolant inflow and the piping for coolant outflow are fitted, are formed in one of the side surfaces of the coupling member. A projected portion is formed at the external circumferential area of these holes and, on the other side surface, a cylindrical portion which is roughly cylindrical in shape and which is to be inserted in the holes in the block type expansion valve, extend from the circumferential edges of the inflow piping connecting through holes and the outflow piping connecting through holes.

In the assembly procedure of the block type expansion valve in the structure above, first, the piping for coolant inflow and the piping for coolant outflow are inserted in the holes in the coupling member. These are temporarily held by crimping the projected portions. Then, the piping for coolant inflow and the piping for coolant outflow are brazed and fixed to the coupling member and finally, the block type expansion valve is secured to the coupling member with screws.

In a structure such as this in the prior art, in which a block type expansion valve is mounted in the vicinity of the intake/outlet portions of a laminated heat exchanger, a separate plate-like member, such as the coupling member described above, is required for fixing the block type expansion valve. To be more specific, as shown in FIG. 9, an expansion valve mounting member (plate-like member) 90 is brazed to the intake/outlet passage for coolant that is formed at one of the end plates of the laminated heat exchanger 100, and a block type expansion valve 110 is secured with screws 92 to the expansion valve mounting member 90 thus brazed. Note that, reference numbers 93, 94 and 95 respectively indicate mounting holes bored through the block type expansion valve 110, screw holes formed in the expansion valve mounting member 90 and O-rings for sealing between the holes in the block type expansion valve 110 and the expansion valve mounting member 90.

As has been explained, since a great number of assembly steps and parts are required during the process of mounting the block type expansion valve on the laminated heat exchanger, the production cost is high and there is also a problem in that the laminated heat exchanger is heavy.

SUMMARY OF THE INVENTION

The object of the present invention is to provide a laminated heat exchanger that does not require an expansion valve mounting member and in which an expansion valve can be mounted without using O-rings or screws.

Accordingly, the present invention is a laminated heat exchanger constituted by laminating tube elements, each of which is provided with a pair of tanks at one end and a U-shaped passage communicating between the pair of tanks, alternately with fins, with a block type expansion valve mounted at a pair of intake/outlet portions which are provided parallel to each other over a specific distance. The block type expansion valve is constituted with a block main body and a temperature sensing, flow metering valve, and is structured by, first, temporarily mounting the block main body on to the pair of intake/outlet portions and brazing it with the laminated heat exchanger in a furnace. Then, the temperature sensing, flow metering valve is mounted into the block main body that has been thus brazed.

In this way, with the laminated heat exchanger according to the present invention, the block main body that constitutes the block type expansion valve is mounted on to the pair of intake/outlet portions formed in the laminated heat exchanger by brazing in a furnace and other components of the block type expansion valve are mounted after the brazing. With a laminated heat exchanger thus structured, since a pair of holes formed in the block main body of the expansion valve are fitted to a pair of intake/outlet portions of the laminated heat exchanger and then brazed in a furnace, and the internal components are mounted in the block main body afterwards, the necessity for an expansion valve mounting member is eliminated and, at the same time, the secureness (strength) of the block main body secured to the intake/outlet portions is improved through brazing. Furthermore, since the sealing is also improved, the necessity for fixing and sealing members such as screws and O-rings is eliminated and, as a result, the number of parts is reduced. This, in turn, achieves a reduction in production costs.

More specifically, the block main body is provided with an intake side coolant passage and an outlet side coolant passage with opening ends that lie parallel to each other over a specific distance and a hole formed at a right angle to the intake side coolant passage and the outlet side coolant passage into which a temperature sensing, flow metering valve is fitted. The temperature sensing, flow metering valve comprises a head portion provided with a sealed space that is partitioned by a diaphragm, a temperature sensing probe that is bonded to the diaphragm, an operating lever that is provided continuously to the temperature sensing probe, a valve plug that comes in contact with the tip of the operating lever, a spring that applies a force to the valve plug toward the operating lever and a cap that holds the other end of the spring.

The position of the pair of intake/outlet portions of this laminated heat exchanger is not limited as long as they are provided parallel to each other over a specific distance. For instance, a pair of holes may be formed in the plate for intake/outlet passage formation or they may be constituted with a communicating hole formed in the tank located at the outermost level and a communicating pipe. They may also be constituted with a hole formed in the end plate and a communicating pipe or with plates for intake/outlet portion formation provided between tanks.

To be more specific, the intake/outlet portions are formed in the plate for intake/outlet portion formation which is mounted at one of the end plates, which are provided at the two ends of the laminated heat exchanger. This plate for intake/outlet portion formation is provided with a pair of intake/outlet passages that communicate between the two holes formed in the end plate and the intake/outlet portions, with one of the two holes communicating with the tanks of the tube elements and the other hole communicating with one end of a communicating pipe, the other end of which connects with a tank at a specific position of the tube elements. Alternatively, the intake/outlet portions may be constituted with two holes formed in one of the end plates provided at the two ends of the laminated heat exchanger, with one of the holes communicating with the tanks of the tube elements and the other hole communicating with one end of a communicating pipe, the other end of which connects with a tank at a specific position in the tube elements. Or, the intake/outlet portions may be constituted with a communicating hole formed in a tank of the tube element located at one end of the laminated heat exchanger and one end of a communicating pipe, the other end of which connects with a tank at a specific position in the tube elements. Or, the intake/outlet portions may be a pair of intake/outlet pipes which extend out from the tanks of tube elements located at two specific positions.

As has been explained, the pair of intake/outlet portions of the laminated heat exchanger may be any one of the various types of intake/outlet portions as long as they are provided parallel to each other over a specific distance and the block main body of the expansion valve can be assembled through brazing in a furnace.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of the embodiments according to the present invention with reference to the drawings.

Figure 1:
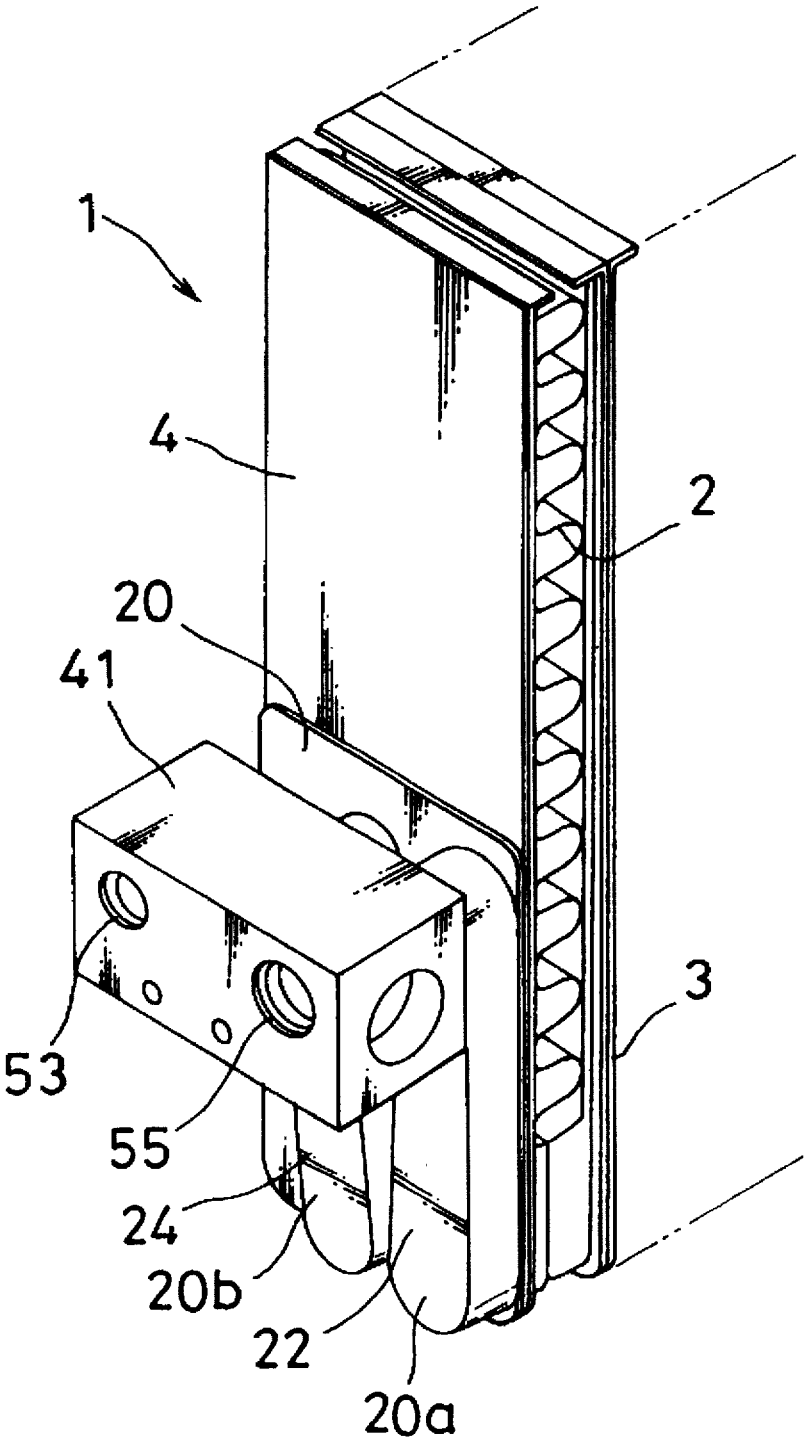
FIG. 1 is a perspective view of the present invention showing a block main body of an expansion valve mounted to an end plate of a laminated heat exchanger through brazing in a furnace.
Figure 2:
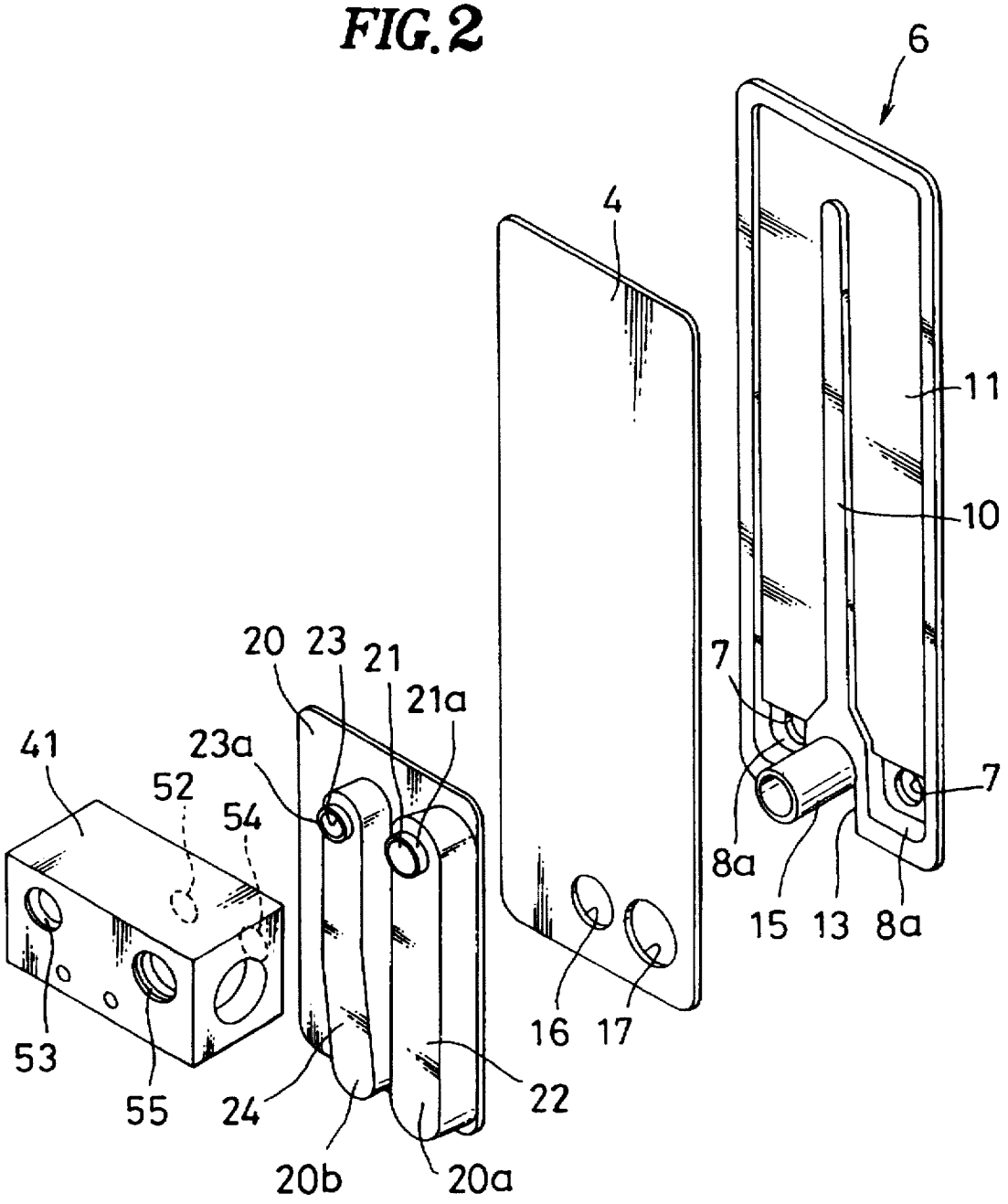
FIG. 2 is an exploded perspective view of the structure shown in FIG. 1.
Figure 3:
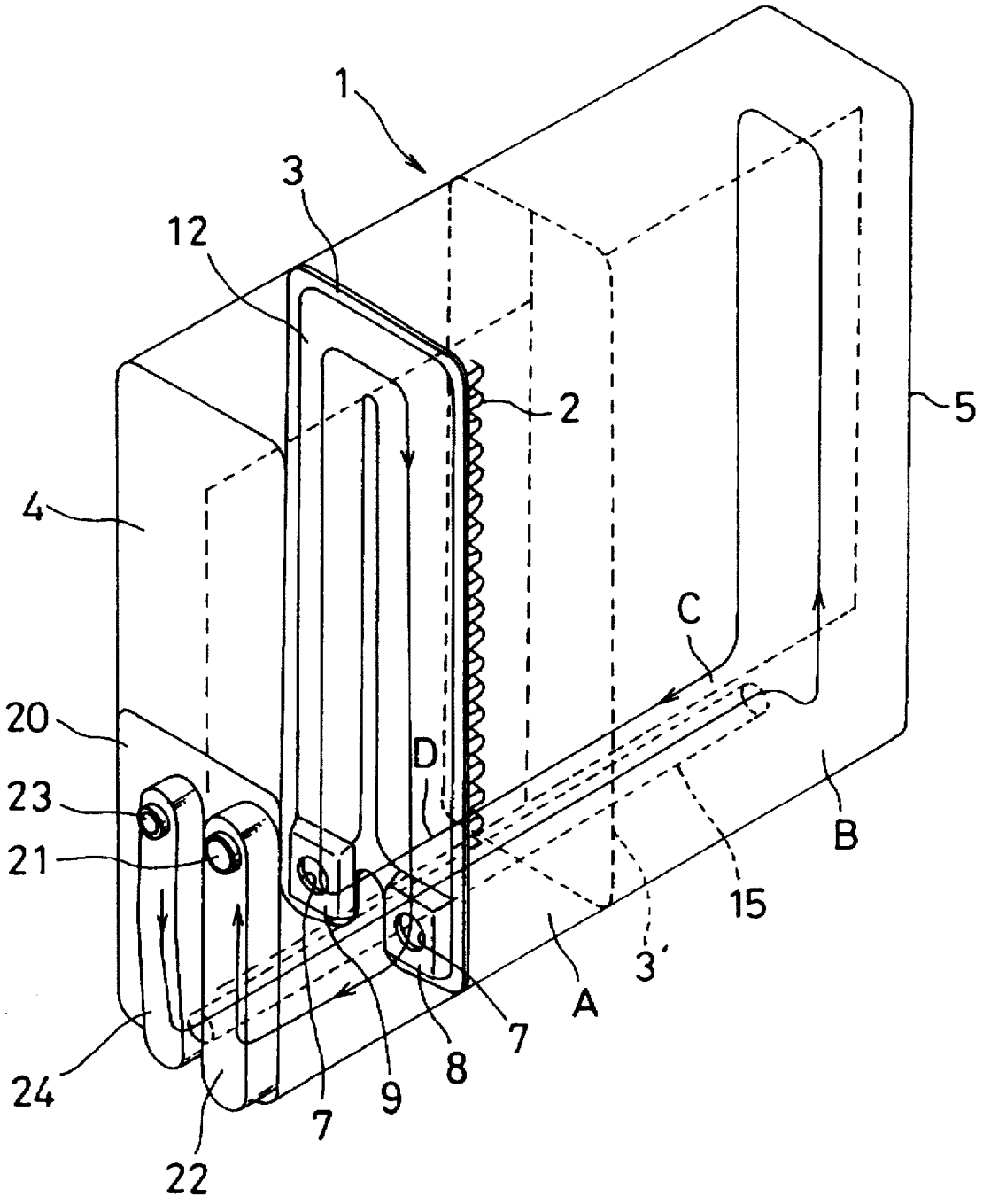
FIG. 3 illustrates one example of the laminated heat exchanger according to the present invention.
Figure 4:
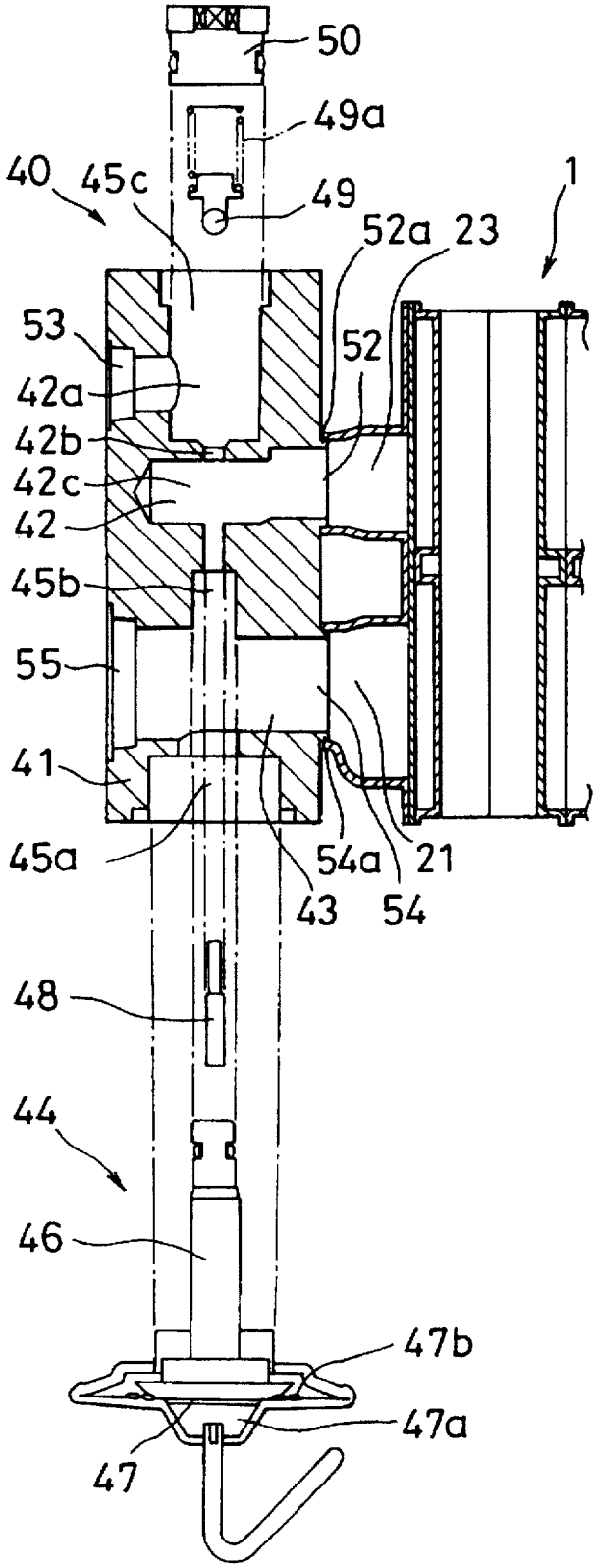
FIG. 4 is a cross sectional view showing the block main body of the expansion valve mounted to the laminated heat exchanger by brazing in a furnace and also illustrates an internal part, i.e., the temperature sensing, flow metering valve.

FIG. 1 shows a block main body 41 of a block type expansion valve 40 mounted on a laminated heat exchanger 1; FIG. 2 is an exploded perspective of the assembly and FIG. 3 shows the laminated heat exchanger 1 with holes 21 and 23 which constitute a pair of intake/outlet portions provided in close proximity so that the block type expansion valve 40 can be mounted. FIG. 4 is a cross section showing the state in which the block main body 41 of the block type expansion valve 40 is brazed.

In FIG. 3, the laminated heat exchanger 1 is formed by laminating tube elements 3 and fins 2 alternately. Each tube element 3 is provided with a pair of tanks 8 and 9 at one end and a U-shaped coolant passage 12, which communicates between the tanks 8 and 9. Each of the tanks 8 and 9 is provided with a communicating hole 7 formed in the direction of the lamination. Tube elements 3 are laminated in such a manner that tank groups A and B and tank groups C and D are formed. Also, in this laminated heat exchanger 1, a tube element 3', in which the tank on one side is a blind tank (i.e., a tank without a communicating hole 7) and is provided (not shown) at the center in the direction of the lamination, to cut off communication between tank group A and tank group B. A so-called 4-pass coolant flow is thus achieved with the tank groups A and B cut off from each other and the tank groups C and D in communication. Also, a communicating pipe 15 is provided at one of the end plates so that a pair of coolant intake/outlet portions can be provided. This communicating pipe 15 communicates between an intake passage 24 and the tanks in the tank group B while the tanks at the end of the tank group A communicate with an outlet passage 22. Note that, a plate 20 for intake/outlet passage formation is secured to the end plate 4 so that the outlet passage 22 and the intake passage 24 can be formed.

Consequently, coolant that has flowed in through the hole 23 of the intake passage 24, flows into the tank group B via the communicating pipe 15. It then flows into the tank group C through a coolant passage 12 which communicates between the tank group B and the tank group C, to be delivered to tank group D from the tank group C. Then, after traveling through the coolant passage 12 that communicates between the tank group D and the tank group A and flowing into the tank group A, the coolant travels through the outlet passage 22 to flow out through the hole 21.

Note that, while in this embodiment, the coolant flows as indicated with the arrows in FIG. 3, the coolant may just as well flow in through the hole 21 and flow out through the hole 23. However, in that case, the direction in which the block type expansion valve is mounted must be reversed.

In FIGS. 1 and 2, the end plates form tube elements at the two sides by blocking off the indented portions of the formed plates, which are to be described below, and in this case, a coolant passage (not shown) and tanks (not shown) are formed, whose volumetric capacities are half that of other tube elements.

A formed plate 6 is formed by dressing the surface of a plate constituted mainly of aluminum, with a brazing material. A pair of distended portions 8*a* for tank formation are formed toward one end and a communicating hole 7 is formed in each distended portions 8*a* for tank formation. A projection 10 extends from approximately the center between the distended portions 8*a* for tank formation toward the other end and extending from the peripheral edge of the projection 10, a distended portion for coolant passage formation 11 is formed, which is roughly U-shaped and communicates between the distended portions 8*a* for tank formation. In addition, an indented portion 13, which is indented toward the inside for accommodating the communicating pipe 15, is formed between the distended portions 8*a* for tank formation which run parallel to each other.

The tube element 3 is constituted by bonding two formed plates 6 face-to-face. Note that, the brazing material is an aluminum alloy and is constituted in such a manner that it has a lower melting point than the plate mentioned earlier, which has aluminum as its main constituent.

Each of the end plates 4 and 5 is formed by dressing the surface of a plate, which is a flat plate whose main constituent is aluminum, with a brazing material. The end plates 4 and 5 block off the formed plates 6 located at the two ends of the laminated heat exchanger 1. One of the end plates is provided with a hole 16, which opens at a position that corresponds to the indented portion 13 of the formed plate 6 and in which the communicating pipe 15 is fitted, and a hole 17, which opens at a position that corresponds to the distended portion 8*a* for tank formation of the formed plate 6.

In addition, a plate 20 for intake/outlet passage formation 20 is provided at the end plate 4. The plate 20 for intake/outlet passage formation is formed by dressing both surfaces of the plate whose main constituent is aluminum with a brazing material.

As shown in FIGS. 2 and 3, the plate for intake/outlet passage formation 20 is provided with a distended portion 20*a* which, in turn, is provided with the hole 21, and a distended portion 20*b* which, in turn is provided with the hole 23. With the distended portions 20*a* and 20*b* blocked off by the end plate 4, the outlet passage 22 that communicates between the hole 17 of the end plate 4 and the hole 21 of the distended portion 20*a*, and the intake passage 24 that communicates between the hole 16 of the end plate 4 and the hole 23 of the distended portion 20*b* are formed.

In order to facilitate brazing the expansion valve 40 to the block main body 41, which is to be detailed below, cylindrical extended portions 21*a* and 23*a* are provided. The cylindrical portions extend axially out from the circumferential edges of the holes 21 and 23 of the distended portions 20*a* and 20*b*, respectively. The portions are formed, as shown in FIGS. 2–4, by means such as burring, in such a manner that the inner surfaces of the extended portions 21*a* and 23*a* come into contact with the outer surfaces of projected portions 52*a* and 54*a* of the block main body 41 which are to be described below.

As shown in FIGS. 2 and 4, the block type expansion valve 40 is formed with an intake side coolant passage 42, which comprises a coolant passage 42*a* that communicates between the holes 53 and 52 formed in the block main body 41 and through which high pressure liquid coolant flows. A passage hole 42*b* which is opened and closed by a valve plug 49 to be explained below. The valve 40 also includes a coolant passage 42*c*, through which low pressure liquid coolant flows, and an outlet side coolant passage 43 which communicates with holes 54 and 55 through which low pressure, gaseous coolant flows. A temperature sensing, flow metering valve 44 is fitted inside longitudinal holes 45*a*, 45*b* and 45*c* which are formed in the block main body 41 at a right angle to the intake side coolant passage 42 and the outlet side coolant passage 43.

The temperature sensing, flow metering valve 44 is includes a diaphragm 47 that partitions a head portion 47*a*, in which coolant is sealed off from a space 47*b* which communicates with the outlet side coolant passage 43. The valve 44 also includes a temperature sensing probe 46 which is mounted on the outer side surface of the diaphragm 47, an operating lever 48 provided continuously with the temperature sensing probe 46, and a valve plug 49, to which a force is applied by a spring 49*a* toward the operating lever 48 to block off the passage hole 42*b*. Also, a cap 50, which retains one end of a spring 49*a* and also blocks off the opening end of the hole 45*c*.

In the temperature sensing, flow metering valve 44, the temperature of the coolant passing through the outlet side coolant passage 43 is communicated to the coolant sealed inside the diaphragm 47 by the temperature sensing probe 46 provided in the coolant passage 43, and the pressure of the coolant passing through the outlet side coolant passage 43 is supplied to the space 47*b* which is on the outside of the diaphragm 47.

With the above arrangement, when the quantity of heat in the coolant passing through the coolant passage 43 is high (when the temperature of the coolant is higher than a specific level and the coolant pressure is lower than a specific level), the coolant sealed inside the diaphragm 47 expands, to apply a force to the diaphragm 47 in an upward direction in the figure. The force on diaphragm 47 causes the operating lever 48 to press the valve plug 49 in a direction that will open the passage hole 42*b*, thereby increasing the quantity of coolant traveling inside the laminated heat exchanger 1. Also, since the quantity of heat in the coolant is reduced (the temperature of the coolant in the coolant passage 43 becomes lower and the coolant pressure increases) when the quantity of coolant in the laminated heat exchanger increases, the coolant inside the diaphragm 47 contracts and the valve plug 49 moves in a direction that closes the passage hole 42*b* and restricts the flow of coolant to the laminated heat exchanger 1. With this, the heat exchanging capacity with which the quantity of heat in the laminated heat exchanger 1 is maintained at a stable level is ensured.

Note that the projected portions 52*a* and 54*a* are provided around the holes 52 and 54 to accommodate the fitting of the extended portions 21*a* and 23*a*.

Figure 5:
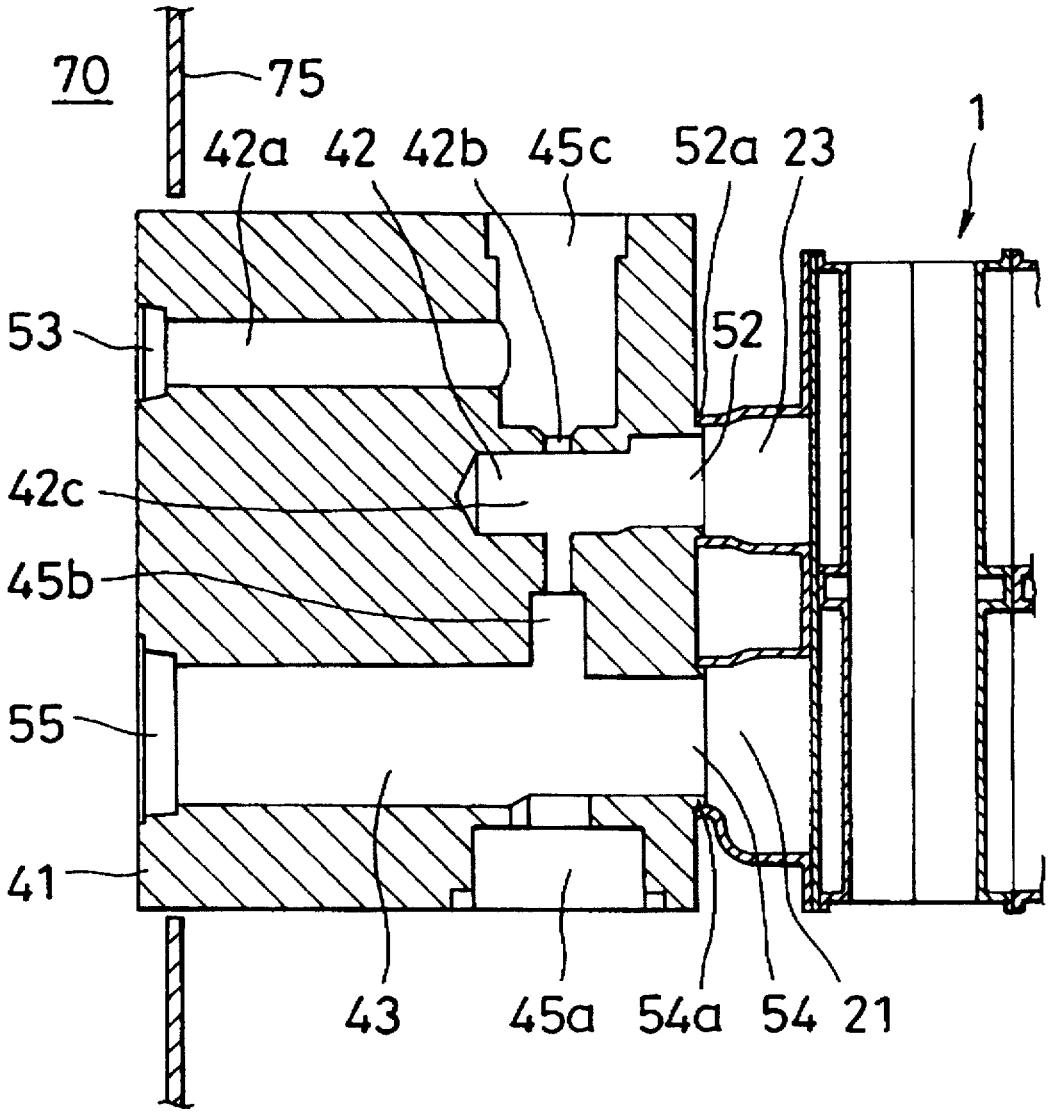
FIG. 5 is a cross sectional view of a variation of the block main body of the expansion valve.

Also note that, the length of the shorter side of the block main body 41 is not limited to any specific measurement. However, for ease of operation, it is desirable that it have a measurement which reaches a fire wall 75 of engine compartment 70, as shown in FIG. 5, for instance.

The process through which the expansion valve 40 is mounted to the extended portions 21*a* and 23*a* of the plate for intake/outlet passage formation 20 in the structure described so far, is explained below. First, the core of the laminated heat exchanger is temporarily assembled by first laminating the fins 2 and the tube elements 3 over a plurality of levels, providing the end plates 4 and 5 at the two ends in the direction of the lamination and also providing the plate for intake/outlet passage formation 20 on the outside of the end plate 4.

Next, after temporarily mounting the block main body 41 of the expansion valve 40 by fitting the projected portions 52*a* and 54*a* into the extended portions 21*a* and 23*a* respectively of the plate 20 for intake/outlet passage formation. Then the core of the laminated heat exchanger on which the block main body 41 is thus temporarily mounted, is placed in a furnace. With this, while the laminated heat exchanger 1 is assembled through brazing in the furnace, the block main body 41 is also brazed to the plate 20 for intake/outlet passage formation.

Then, as shown in FIG. 4, the temperature sensing, flow metering valve 44, the valve plug 49, and the cap 50, are mounted in the longitudinal holes 45*a*, 45*b* and 45*c* of the block main body 41 which has already been mounted to the laminated heat exchanger 1 to complete the mounting process.

Note that, the explanation has been given so far for a case in which a plate for intake/outlet passage formation is provided toward the outside of the end plate 4 in the direction of the lamination. Also, a pair of holes, formed in the block main body 41 of the expansion valve 40, are brazed to the pair of holes 21 and 23 of the plate 20 for intake/outlet passage formation, in order to mount the expansion valve 40. However, the method is not limited to this arrangement.

Figure 6:
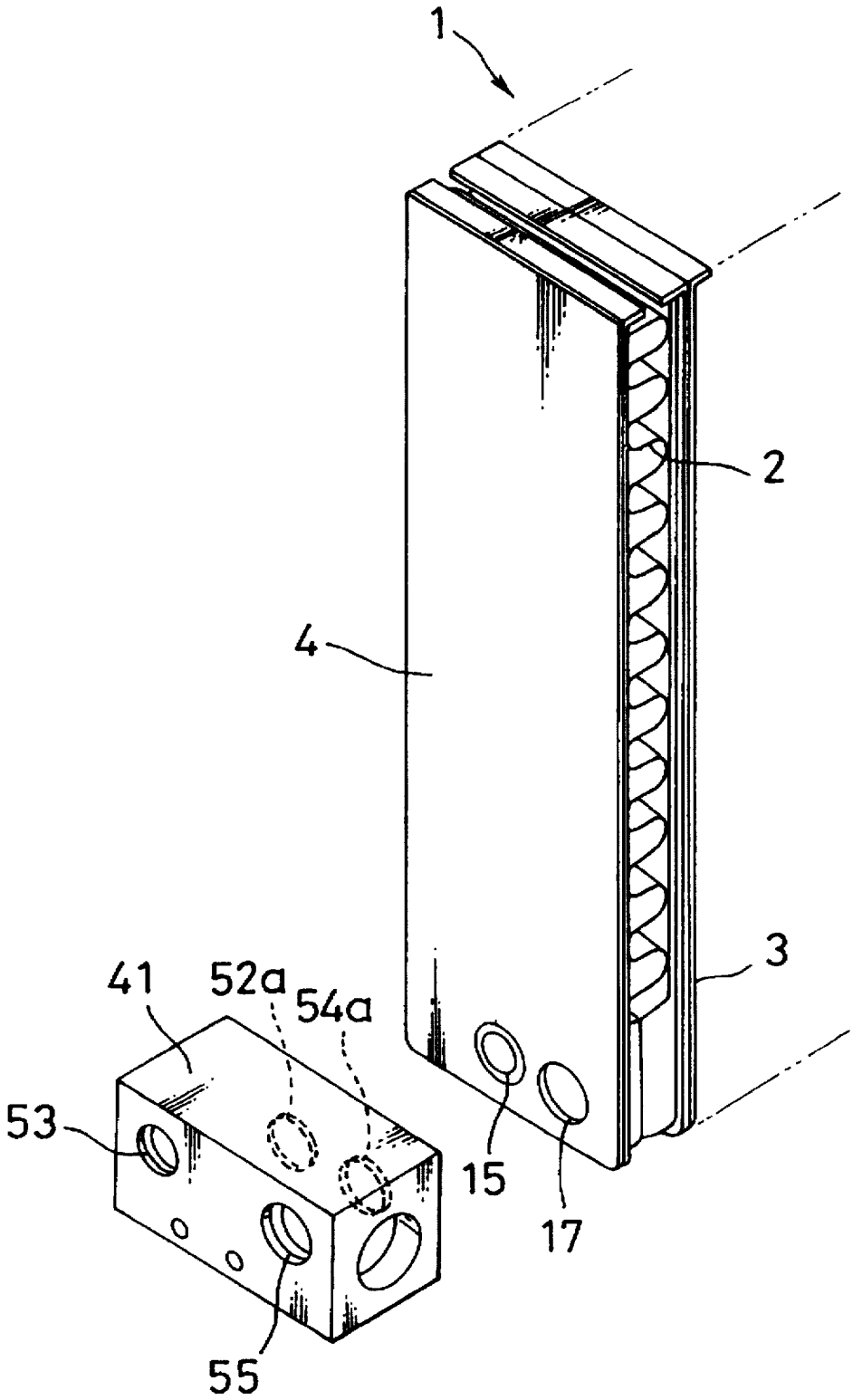
FIG. 6 is an exploded perspective view of another embodiment pertaining to the positions at which the block main body of the expansion valve is mounted to the laminated heat exchanger.

In the embodiment shown in FIG. 6, instead of mounting the plate 20 for intake/outlet passage formation at the end plate 4, the projected portions 52*a* and 54*a* of the block main body 41 of the expansion valve 40 are fitted to the hole 17, which communicates with the communicating hole 7 formed in the tank 8, and to one end of the communicating pipe 15, which emerges from the end plate. The block main body 41 and the end plate 4 are directly brazed in the furnace. With this, when the space for accommodating the block type expansion valve is located in the lower portion of the side of the laminated heat exchanger 1, by directly mounting the block main body 41 on the end plate 4 as described above, a further reduction in the number of parts is achieved, since the plate 20 is thus eliminated, which results in a cost reduction.

Figure 7:
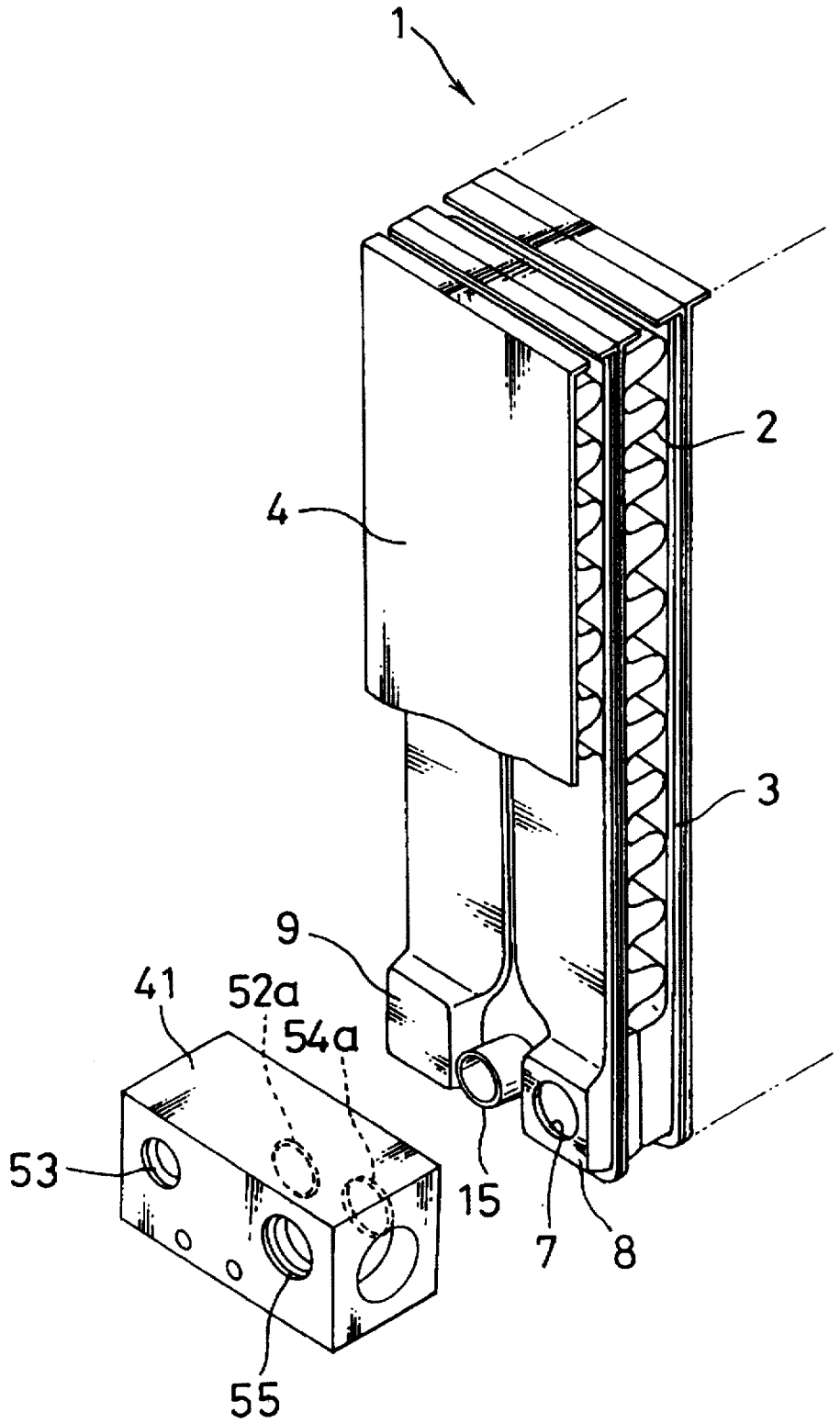
FIG. 7 is an exploded perspective view of yet another embodiment pertaining to the positions at which the block main body of the expansion valve is mounted to the laminated heat exchanger.

In the embodiment shown in FIG. 7, the communicating hole formed in the tank 8 of the tube element 3 constituting the laminated heat exchanger 1 and the communicating pipe 15 are exposed and the pair of projecting portions 52*a* and 54*a* of the block main body 41 of the expansion valve 40 are fitted into the communicating hole 7 and into one end of the communicating pipe 15 before the assembly is brazed in the furnace. In this case, although the end plate 4 is shown as a cut-away in the figure, in reality it extends out to the end of the block main body 41 of the expansion valve 40 to enclose the fins 2 between itself and the tube elements 3.

Figure 8:
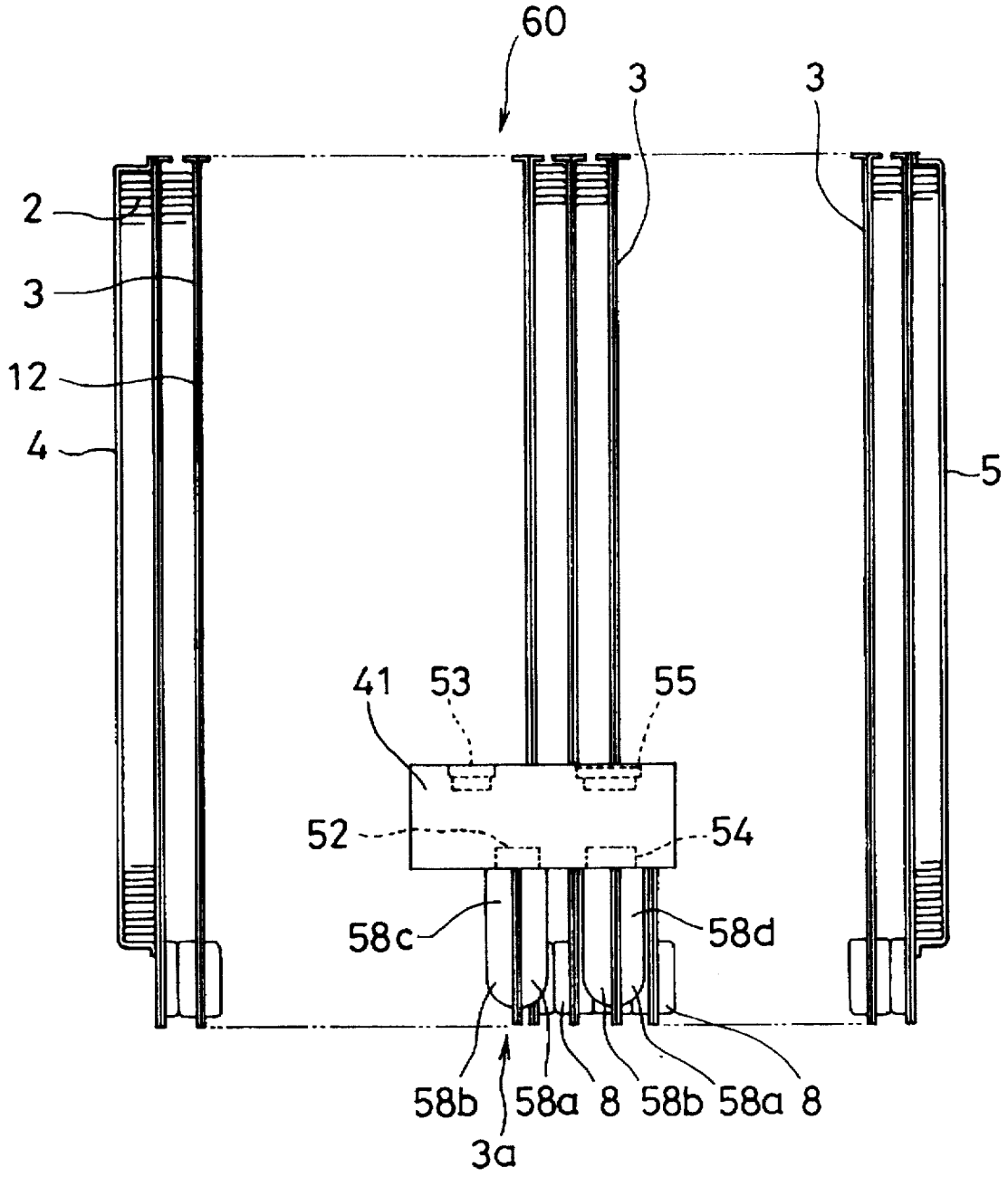
FIG. 8 illustrates the block main body of the expansion valve which is mounted at the intake/outlet portions which are constituted with a plate for intake/outlet portion formation.
Figure 9:
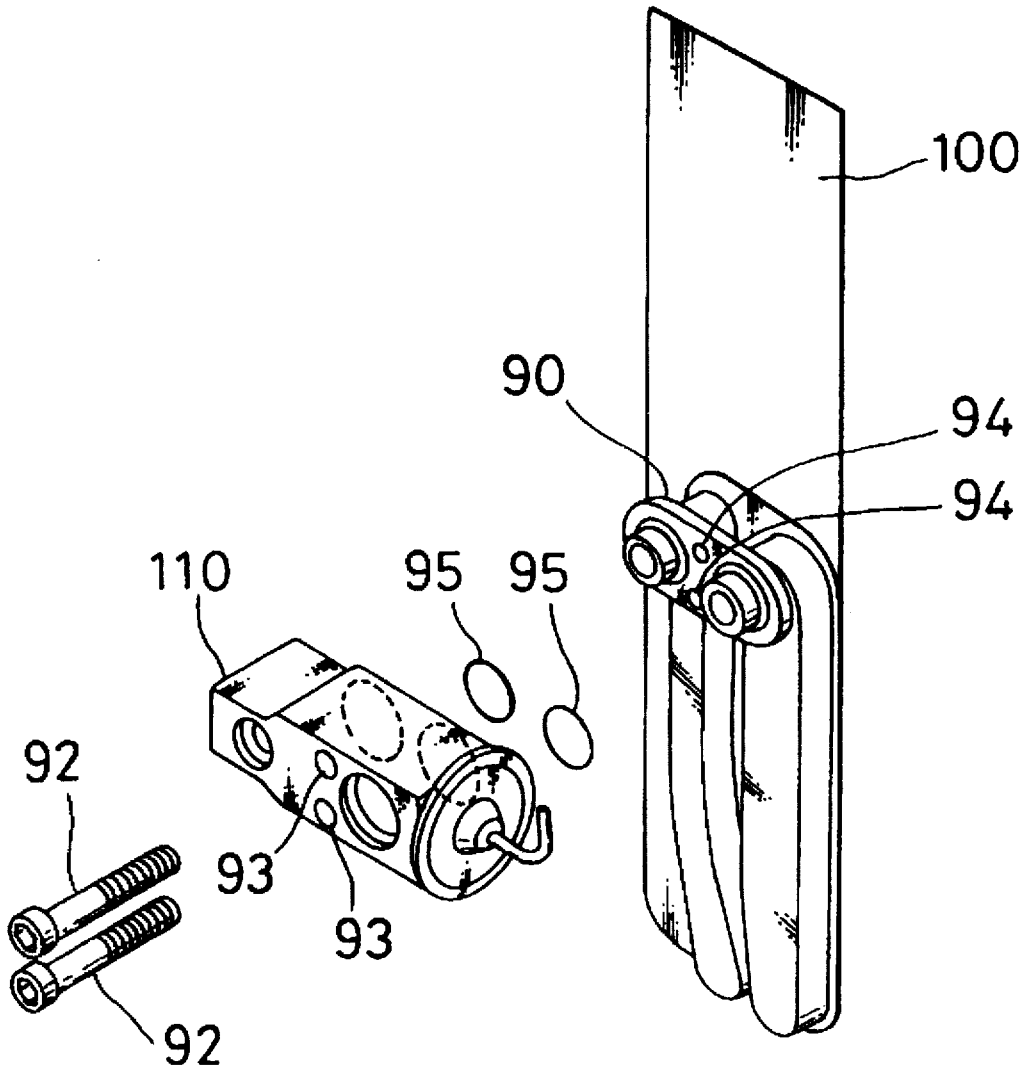
FIG. 9 PRIOR ART
FIG. 9 illustrates the assembly of a prior art expansion valve to a laminated heat exchanger.

In addition, in the embodiment shown in FIG. 8, the laminated heat exchanger 60 is provided with tube elements 3*a*, each of which is constituted by bonding formed plates face-to-face, each of which, in turn, is provided with distended portions 58*a* and 58*b* which, when bonded together, form intake/outlet pipes 58*c* and 58*d*. The block main body 41 of the expansion valve 40 is mounted at the ends of the intake/outlet pipes 58*c* and 58*d*. The pipes 58*c* and 58*d* are formed of the distended portions 58*a* and 58*b*, and are connected to a pair of holes, 52 and 54, formed in the block main body 41.

In all of these instances, as long as the intake and outlet portions for heat exchanging medium in the laminated heat exchanger are provided parallel to each other over a specific distance (the distance between the holes 52 and 54 formed in the block main body), the block main body of the block type expansion valve can be brazed directly to the laminated heat exchanger 1, achieving the object of the present invention.

As has been explained so far, with the laminated heat exchanger according to the present invention, since the block main body of the expansion valve is brazed along with the laminated heat exchanger in the furnace, with the internal components of the expansion valve being mounted in the block main body afterwards, the necessity for an expansion valve mounting member is eliminated. Also, since neither screws nor O-rings are required in assembling the expansion valve to the laminated heat exchanger, the overall number of parts is reduced, resulting in a reduction in the number of assembling steps for the expansion valve and also in production costs. This also achieves a reduction in the weight of the laminated heat exchanger.

What is claimed is:

1. A laminated heat exchanger comprising:

a plurality of fluidly connected laminated tube elements each defining a pair of tanks and a U-shaped passage establishing fluid communication between said pair of tanks, wherein said pairs of tanks of said plurality of tube elements define a pair of tank groups, one of said tank groups defines two tank sub groups which are formed by partitioning said one of said tank groups at a specific position, and the other of said pair of tank groups is defined by a number of said tanks connected in series;

fins provided between adjacent tube elements of said plurality of tube elements;

a first end plate located at a first end of said plurality of tube elements in a direction of lamination of said tube elements, said first end plate having a first hole fluidly communicating with one of said tank sub groups and a second hole;

a pipe providing fluid communication between the other of said tank sub groups and said second hole of said first end plate;

a second end plate located at a second end of said plurality of tube elements in a direction of lamination of said tube elements;

a plate structure connected to said first end plate so as to define an outlet passage and an inlet passage extending from said first hole and second hole, respectively, to a central portion of said first end plate;

an intake portion connected to said intake passage at an end thereof which is remote from said second hole;

an outlet portion connected to said outlet passage at an end thereof which is remote from said first hole; and a block type expansion valve including a block main body brazed on said intake portion and outlet portion during brazing of said heat exchanger, and a temperature sensing, flow metering valve mounted in said block body after brazing said heat exchanger.

2. The laminated heat exchanger as claimed in claim 1, wherein said temperature sensing flow metering valve comprises:

a head portion defining a sealed space;

a diaphragm connected to said head portion so as to partition said sealed space;

a temperature sensing probe mounted on said diaphragm;

an operating lever integrally connected to said temperature sensing probe;

a valve plug abutting said operating lever;

a cap secured to said block main body; and a spring located between said cap and said valve plug so as to bias said valve plug in a direction toward said operating lever.

3. The laminated heat exchanger as claimed in claim 1, wherein said block main body comprises:

an outlet coolant passage extending through said block main body and communicating with said outlet portion;

an intake coolant passage communicating with said intake portion and having a narrowed diameter portion which can be opened and closed by a valve; and a longitudinal passage extending perpendicularly through said outlet coolant passage and said intake coolant passage.

4. The laminated heat exchanger as claimed in claim 3, wherein said temperature sensing flow metering valve comprises:

a head portion engaged in one end of said longitudinal passage and defining a sealed space;

a diaphragm connected to said head portion so as to partition said sealed space;

a temperature sensing probe mounted on said diaphragm;

an operating lever integrally connected to said temperature sensing probe;

a valve plug abutting said operating lever and operating to open and close said narrowed diameter portion of said intake coolant passage;

a cap engaging the other end of said longitudinal passage; and a spring located between said cap and said valve plug so as to bias said valve plug in a direction toward said operating lever.

5. The laminated heat exchanger as claimed in claim 4, wherein:

said head portion, said temperature sensing probe and said operating lever are inserted into said one end of said longitudinal passage; and said valve plug and said spring are inserted into said other end of said longitudinal passage which is closed by said cap.

* * * * *